United States Patent [19]

Buono

[11] Patent Number: 5,005,718

[45] Date of Patent: Apr. 9, 1991

[54] TAMPER-EVIDENT CHILD RESISTANT CLOSURE DEVICE

[75] Inventor: Caetano Buono, Staten Island, N.Y.

[73] Assignee: Van Blarcom Closures, Inc., Brooklyn, N.Y.

[21] Appl. No.: 409,276

[22] Filed: Sep. 19, 1989

Related U.S. Application Data

[63] Continuation of Ser. No. 228,294, Aug. 4, 1988, abandoned.

[51] Int. Cl.[5] ..... B65D 55/02

[52] U.S. Cl. ..... 215/220; 215/251

[56] References Cited

U.S. PATENT DOCUMENTS

| | | | |
|---|---|---|---|
| 3,946,889 | 3/1976 | Gach | 215/219 |
| 3,946,890 | 3/1976 | Sluderi | 215/220 |
| 4,069,935 | 1/1978 | Hampel | 215/220 |
| 4,165,813 | 8/1979 | Babiol | 215/220 |
| 4,371,088 | 2/1983 | Gach | 215/220 |
| 4,474,301 | 10/1984 | Davis | 215/220 |
| 4,523,688 | 6/1985 | Puresevil et al. | 215/220 |
| 4,526,283 | 7/1985 | Skinner | 215/251 |
| 4,527,701 | 7/1985 | Schaubeck | 215/220 |
| 4,570,809 | 2/1986 | Archer | 215/220 |
| 4,632,264 | 12/1986 | Evans | 215/220 |
| 4,669,620 | 6/1987 | Coifman | 215/220 |
| 4,673,095 | 6/1987 | Puresevic et al. | 215/220 |
| 4,801,028 | 1/1989 | Puresevic et al. | 215/220 |

*Primary Examiner*—Stephen Marcus
*Assistant Examiner*—Nova Stucker
*Attorney, Agent, or Firm*—Cohen, Pontani & Lieberman

[57] ABSTRACT

A tamper-evident child resistant closure device is provided. The tamper-evident child resistant closure device includes an inner cap having a first set of teeth, an outer cap which fits movably over the inner cap and has a second set of teeth adapted to operatively engage the first set of teeth to facilitate removal of the closure device and inactivatable engagement prevention means for preventing engagement of the first and second sets of teeth. The engagement prevention means functions independently of the configuration of a container on which the closure is used and prevents the removal of the closure device from the container. Once the engagement prevention means are inactivated, the first set of teeth on the inner cap can engage the second set of teeth on the outer cap when the outer cap is displaced axially downwardly with respect to the inner cap. The closure device can be taken off a botttle when the teeth are engaged. The inactivation of the engagement preventing means provides a visual indication that the container has been previously opened or tampered with.

2 Claims, 4 Drawing Sheets

TAMPER-EVIDENT CHILD RESISTANT CLOSURE DEVICE

This is a continuation of U.S. Application Ser. No. 228,294, filed Aug. 4, 1988.

FIELD OF THE INVENTION

This invention relates generally to tamper-evident, child resistant closure devices and in particular, to a tamper-evident child resistant closure device which functions independently of the configuration of the container on which it is used.

BACKGROUND OF THE INVENTION

Child resistant closure devices for containers having a threaded neck are known and are described, for example, in U.S. Pat. Nos. 3,733,000; 3,809,274; 3,924,770; and 3,946,890 issued to Scuderi on May 15, 1973; May 7, 1974; Dec. 9, 1975; and Mar. 30, 1976, respectively. Each of these patents describes a closure device including a screw type cap and a drive member which fits movably over the cap. The screw type cap, often an inner cap, has a first circle of teeth on the side wall of the cap. The drive member, often an outer cap that fits over and around the inner cap, has a second circle of teeth adapted to engage the first circle of teeth when the drive member is pressed firmly in the direction of the inner cap. It is, therefore, necessary to simultaneously press and turn the drive member in order to unscrew the cap. Such closure devices are considered to be child resistant since it is unlikely that a small child would appreciate the necessity for simultaneously pressing and turning the drive member and, even if this is appreciated, a small child is unlikely to have sufficient strength to perform these functions simultaneously.

Child resistant closures such as those described in the Scuderi patents are not "tamper-evident", meaning that they do not include means which indicate if the container has been opened after leaving the factory and prior to purchase. This raises the possibility that the contents of the container can be tampered with prior to use by a consumer without the consumer knowing. Since many child resistant caps are used with medications, it is desirable that the cap produce an indication of unauthorized opening of the container.

U.S. Pat. Nos. 3,837,518 issued to Gach on Sept. 24, 1974 shows a child resistant closure with a tamper-evident feature. The Gach closure includes an inverted cup-shaped inner cap and an outer overcap. A tamper-evident tear strip forms part of the overcap skirt and rests against a shoulder on a bottle. This prevents downward movement of the outer cap, which is required for transmitting bottle opening rotation to the inner cap. Accordingly, co-operating clutch means on the inner and outer caps of a Gach closure cannot be engaged until the tamper-evident tear strip is removed.

However, operation of the Gach closure is dependent upon the configuration of the container on which it is used. Specifically, the closure does not function for its intended purpose unless the container has a shoulder so positioned that when the Gach closure is closed the tear strip must abut against the shoulder to force and hold the outer cap up and thus prevent engagement of the clutch. There are numerous other patents which also disclose a child resistant cap with a tamper-evident feature.

None of the prior art, however, teaches or suggests a tamper-evident child resistant closure device formed of an inner cap and an outer cap wherein means for preventing engagement of a first circle of teeth on the inner cap with a second circle of teeth on the outer cap is provided in such a way as to be independent of the container configuration for its operativeness.

It is, therefore, an object of the invention to provide a tamper-evident child resistant closure device which does not require a special bottle configuration.

Another object of the invention is to provide a simple tamper-evident child resistant closure device.

A further object of the invention is to provide a tamper-evident child resistant closure device which can be readily installed on a bottle during a manufacturing process.

Still other objects and advantages of the invention will in part be obvious and will in part be apparent from the specification.

SUMMARY OF THE INVENTION

Generally, speaking in accordance with the invention a tamper-evident child resistant closure device is provided. The tamper-evident child resistant closure device includes an inner cap having a first set of teeth, an outer cap which movably fits over the inner cap and has a second set of teeth adapted to operatively engage the first set of teeth to rotate the inner cap in response to rotation of the outer cap to effect removal of the closure device and inactivatable means for preventing engagement of the first and second sets of teeth, said inactivatable means not relying in whole or in part on the container construction for its efficiency. The inactivatable means must be inactivated before taking the closure off the container for the first time and, when inactivated, provides an indication that the container has previously been opened or tampered with. A preferred mode of inactivating said means for preventing engagement of said two sets of teeth is by removing at least a portion of said means. Once the inactivatable means are inactivated, the first set of teeth on the inner cap can engage the second set of teeth on the outer cap when the outer cap is displaced axially downwardly with respect to the inner cap. The closure device can be taken off a container when the teeth are engaged.

The invention accordingly comprises the features of construction, combination of elements, and arrangements of parts which will be exemplified in the constructions hereinafter set forth and the scope of the invention will be indicated in the claims.

DETAILED DESCRIPTION OF THE DRAWINGS

For a fuller understanding of the invention, reference is had to the following description taken in connection with the accompanying drawings in which.

DESCRIPTION OF THE PREFERRED EMBODIMENTS

Figure 1:
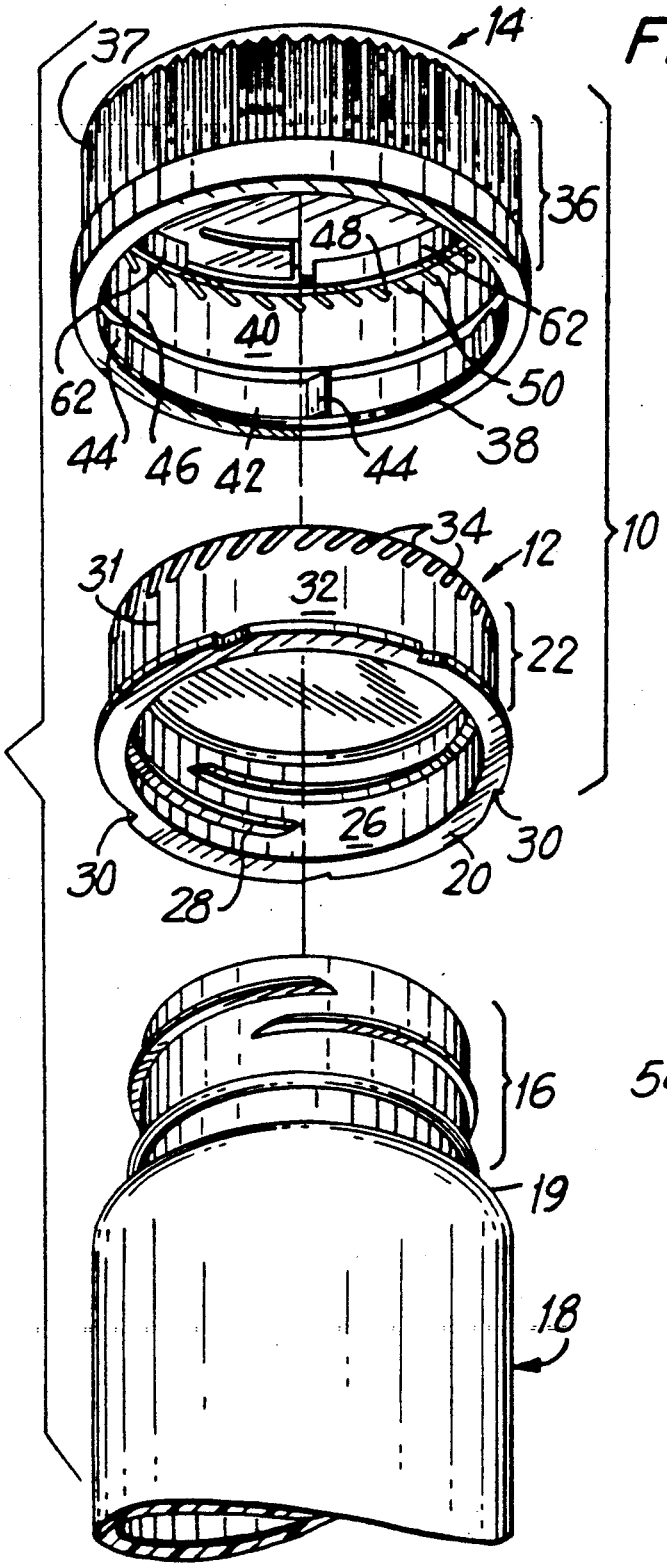
FIG. 1 is an exploded perspective view of a tamper-evident child-proof closure device and bottle constructed and arranged in accordance with a first embodiment of the invention.

The tamper-evident child resistant closure device provided in accordance with the invention includes an inner cap having a first set of teeth, an outer cap which movably fits over the inner cap and has a second set of teeth adapted to operatively engage the first set of teeth to rotate the inner cap in response to rotation of the outer cap for effecting removal of the closure device from a container and inactivatable means for preventing engagement of the first and second sets of teeth prior to inactivation, said inactivatable means being independent of the configuration of the container on which the closure device is used. A few of the presently preferred embodiments are discussed in detail below for purposes of illustrating the invention.

Referring specifically to FIGS. 1 to 5 of the drawings, a tamper-evident child resistant closure 10 constructed and arranged in accordance with a first embodiment of this invention is depicted. Closure 10 includes an inner cap 12 and an outer cap 14 which is proportioned so that it may move longitudinally and rotationally relative to inner cap 12. Both outer cap 14 and inner cap 12 are cylindrical, the inner cap having a cylindrical side wall or skirt 31 and a top 24, the outer cap having a cylindrical side wall or skirt 37 and a top 54. The inner diameter of the side wall skirt of the outer cap is somewhat larger than the outer diameter of the side wall of the inner cap whereby to enable the two caps to move longitudinally relative to one another as previously described. If the outer cap is disposed upwardly relative to the inner cap, the outer cap is free to rotate relative to the inner cap, the inner cap remaining stationary. However, in accordance with the well known technology from the field of child-resistant closures, means are included on the inner and outer caps which are engaged to connect the two when the outer cap is moved longitudinally in a predetermined direction (e.g. up or down) relative to the inner cap whereby to enable the inner cap to be turned when the outer cap is twisted Thus, to remove the child resistant closure of FIGS. 1 to 5 from the mouth of a container, the outer cap must be pressed downwardly of the inner cap and simultaneously rotated, whereby the engaging means will engage upon the downward movement being effected and will then act as a clutch for transmitting the turning motion of the outer cap to the inner cap. Of course, if desired, the embodiment of FIGS. 1 to 5 could be arranged so that engagement occurs upon upward relative movement rather than downward.

As shown in FIG. 1, the form of means for engaging the inner and outer caps so that they will rotate concommitantly include a first circle of angular teeth or knurling 34 on the outer surface 32 of the side wall 31 of the inner cap 12, and a second circle of angled teeth or knurling 50 on the inner surface 40 of the side wall 37 of the outer cap 14. These angled teeth on both the outer and inner cap are preferably angled downward in the direction of rotation required for closing the container 18. With such a disposition of the two circles of teeth, when the outer cap is rotated clockwise to close the container, the teeth will engage and will cam the outer cap downwardly in the direction of the inner cap to effect a meshing of the two circles of teeth 34 and 50 and thus enable the inner cap to sealingly close about the neck of the container 18. However, when it is desired to open the container, if force is not exerted on the outer cap 14 longitudinally in the direction of the inner cap 12, what will happen is rotation of the outer cap will cause the outer cap to be cammed upwardly in a longitudinal direction away from the inner cap whereby to disengage the two circles of teeth and cause the inner cap to remain stationary. However, if, at the time the outer cap 14 is being turned in an opening or counter-clockwise direction it is also pushed downwardly towards the inner cap, that pushing force can overcome the camming force tending to disengage the two sets of teeth and will keep them engaged, whereby to enable the two sets of teeth 34 and 50 to again act as a clutch in order to transmit the counter-clockwise rotation of the outer cap to the inner cap, whereby to unscrew the inner cap and thereby disengage the closure from the container. This is the preferred form of means for effecting the child resistant feature of the present invention. Of course other means for drivingly connecting the inner and outer caps to one another may be employed without departing from this invention.

In accordance with the present invention, in addition to the child resistant closure feature as heretofore described, inactivatable means are included for preventing the outer cap from moving downwardly relative to the inner cap to effect a meshing relationship between the teeth 34 and 50 whereby to prevent transmission of torque from the outer cap to the inner cap in either a clockwise or counter-clockwise direction in order to turn the lower cap relative to the container. As already noted, such engagement preventing means are inactivatable and when inactivated yield an evident indication of tampering and also free the inner and outer caps for relative longitudinal movement to enable the cap to thereafter function as a conventional child resistant closure. The inactivatable means for preventing the relative longitudinal movement 24 between the inner and outer caps may be a spacer member between top 58 and top 60. In the embodiment shown in FIGS. 1 to 5 the spacer member is in the form of an arcuate skirt 62, here shown as cylindrical and continuous but which can be discontinuous, that depends from the top 60 of the outer closure 14, which skirt engages the top 24 of the inner cap to hold the two circles of teeth out of engagement with one another and prevents downward longitudinal movement of the outer cap relative to the inner cap which would effect such engagement. Thus, as may be seen in FIG. 3, the outer cap is held longitudinally away from the inner cap so that the circles of teeth cannot mesh. Therefore, rotation of the outer cap in an opening or counter-clockwise direction will have no effect on the inner cap. It will not turn. It could not thus be used to open the container 18.

The inactivatable tamper-evident feature or downwardly extending flange 62 is inactivatable by removal of flange 62 from the top of outer cap 14 by tearing the top portion 58 (and the underlying flange 62) from the outer cap 14, as will be described in greater detail subsequently. As noted, closure device 10 cannot be removed from bottle 18 prior to removal of flange 62. Once flange 62 is removed, outer cap 14 is free to move downwardly relative to inner cap 12 so that second circle of teeth 50 can be moved into engagement with first circle of teeth 34 to transmit rotational motion from outer cap 14 to inner cap 12, thereby permitting closure device 10 to be disengaged from bottle 18. Although bottle 18 is shown as having a shoulder 19, one will readily appreciate that bottle 18 can be cylindrical or any other shape with a threaded neck since the tamper-evident feature is not dependent on the container configuration on which the closure device is used.

As shown in FIGS. 1–5, inner cap 12 preferably includes a radial flange 20, a cylindrical skirt 22 adjacent radial flange 20 and extending upwardly therefrom and a cover or top 24 positioned atop skirt 22 so as to cover the area defined thereby. Although this configuration of inner cap 12 is shown by way of example, it is to be understood that any configuration available in the art of child resistant closures can be used.

With the inactivatable means for preventing the relative longitudinal movement in place and working, the teeth 34 and 50 cannot mesh to impart closing direotion (clockwise) rotation from the outer cap 14 to the inner cap 12. To avoid this problem and thus to enable the closure to be screwed onto the bottle while the inactivatable means remains activated to prevent teeth 34 and 50 from meshing, a means for transferring closing rotation from the outer cap 14 to the inner cap 12 is preferably included. Such means are included in the embodiment of FIGS. 1–5.

As shown in FIGS. 1 to 5, radial flange 20 includes a plurality of notches 30 for operative engagement with outer cap 14. Notches 30 are configured in a saw tooth or ratchet fashion so as to grip projections 44 on outer cap 14 when inner cap 12 is rotated counter-clockwise with respect to outer cap 14 and to pass over the projections during clockwise rotation. This permits the inner cap 12 to be rotated in a closing direction an thus be threadedly engaged with a container 18 prior to inactivation of the inactivatable tamper-evident feature and with the teeth 34 and 50 being held out of engagement thereby. Thus the initial closing of the closure can be effected.

An interior surface 26 of inner cap 12 includes threads 28 for threadedly engaging threaded neck 16 of bottle 18 and securing closure device 10 onto bottle 18. An outer surface 32 of inner cap 12 includes a first set of teeth 34 shown in this embodiment as a plurality of slanted notches provided on skirt 22 substantially adjacent top 24 for ratcheting engagement with corresponding projections on the interior surface of outer cap 14. Although the teeth 34 shown in this embodiment are angular, it is to be understood that the invention is not limited by the specific arrangement of teeth 34 and 50. Ratcheting teeth on child resistant closure devices are well known and available in the art. For example, the teeth need not be angled, but can be provided in a straight up and down configuration. It has also been suggested that teeth having curved as opposed to sharp edges increases the child resistant capacity of the closure by making engagement a bit more difficult.

Cover or top 24 of inner cap 12 is preferably substantially flat. In a preferred embodiment, cover 24 includes instructions printed, molded, embossed or impressed thereon for bringing outer cap 14 into engagement with inner cap 12 for opening bottle 18. It is also to be understood that the manner of providing the instructions on the cover or top 24 is not critical and any suitable means for providing such instructions can be used in accordance with the invention. Suitable instructions are shown, for example, in FIG. 4.

Outer cap or drive member 14 fits movably over inner cap 12 so that inner cap 12 and outer cap 14 can be brought into operative engagement to open and close bottle 18. As shown in FIGS. 1–5, outer cap or drive member 14 includes cylindrical skirt 36 preferably having an inwardly extending flange 38 adjacent the bottom thereof and an outer cap cover 60. Inwardly extending flange 38 is preferably provided for maintaining the integrity of closure device 10, that is, for maintaining inner cap 12 within outer cap 14 and it is to be understood that any structure which will perform this function is within the scope of the invention. Integrity can be maintained by providing at least one inwardly extending projection which need not extend around the entire circumference of skirt 36.

An inner surface 40 of outer cap skirt 36 can, for purposes of explanation only, be subdivided into three sections. A lowermost section 42 adjacent inwardly extending flange 38 includes the plurality of projections 44 provided for alignment with the notches 30 in radial flange 20 of inner cap 12. These elements 30 and 44 provide a means for effecting initial closure of a container 18 a previously described.

A center sectiсn 46 of inner surface 40 abuts lower most section 42 and is substantially smooth permitting free rotation of inner cap 12 inside drive member 14. An uppermost section 48 abuts center section 46 and includes the second set or circle of teeth 50 shown here as a plurality cf slanted radially extending projections 50 which can be brought into alignment with first circle of teeth 34 of inner cap 12 by downward axial displacement of outer cap 14 with respect to inner cap 12 in the absence of a tamper-evident feature. Engagement of second set of teeth 50 with first set of teeth 34 permits rotational motion of outer cap 14 to be transmitted to inner cap 12 to threadedly disengage closure device 10 from container 18.

Outer cap cover or top 60 preferably extends across the top of cylindrical skirt 36 and covers the area bounded by skirt 36 with a substantially planar surface. However, outer cap cover or top 60 need not be present so long as the inactivatable tamper-evident feature can be inactivated without leaving container 18 perpetually open.

As reviously mentioned, in the embodiment of the invention shown in FIGS. 1–5, an outer cap cover 52 is provided and at least a portion of outer cap cover 60 is a removable tamper-evident portion 58 which is frangibly connected to the remainder of outer cap cover 60.

Removable tamper-evident portion 58 can be frangibly connected to the remainder of outer cap cover 56, for example, by using a plurality of connecting tabs 56. It is readily apparent that at least one connecting tab 56 must be used, but that more, while preferred, are not required. Instructions for removing tamper-evident portion 58 are preferably printed, molded, embossed or impressed on the outer cap cover 60.

As shown in this embodiment, removable tamper-evident portion 58 includes the downwardly extending flange 62 which, as already described, maintains second circle of teeth 50 out of engagement with first circle of teeth 34. It is to be understood that although the inattivatable tamper-evident feature in this embodiment is shown as a removable tamper-evident portion 58 having a downwardly extending flange thereon, any inactivatable means for maintaining first set of teeth 34 out of engagement with second circle of teeth 50 without dependence on the container configuration is contemplated within the scope of the invention. Although removable tamper-evident features are presently provided in accordance with the preferred embodiments of the invention, tamper-evident features having other inactivation means are also contemplated. Thus, for example, the top 24 of inner cap 12 can be provided with one or more upstanding protruberances which engage the top 58 of outer cap 14 for preventing longitudinal movement between the inner and outer caps. So long as the outer top 60 has a movable portion 58 in register with the protruberances, when the movable portion is moved it will no longer engage the protruberances and the inner and outer caps will be free to move longitudinally of one another. In addition, any flange, tab or other construction which will maintain first circle of teeth 34 out of alignment with second circle of teeth 50 without reliance on the bottle configuration is considered to be within the scope of the invention.

Figure 2:
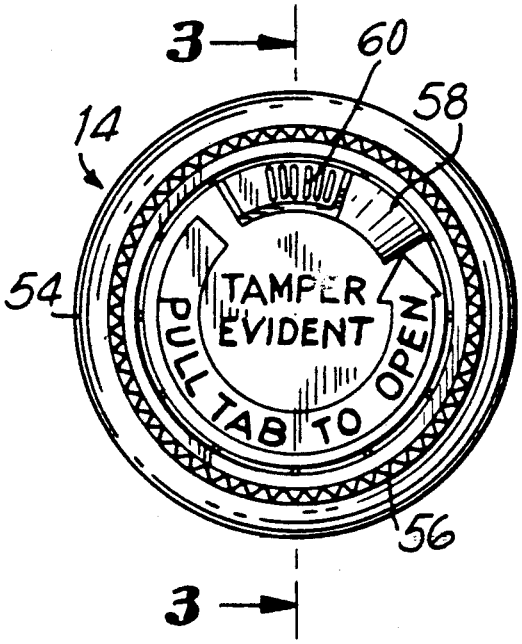
FIG. 2 is a top plan view of the tamper-evident child-proof closure device of FIG. 1.
Figure 3:
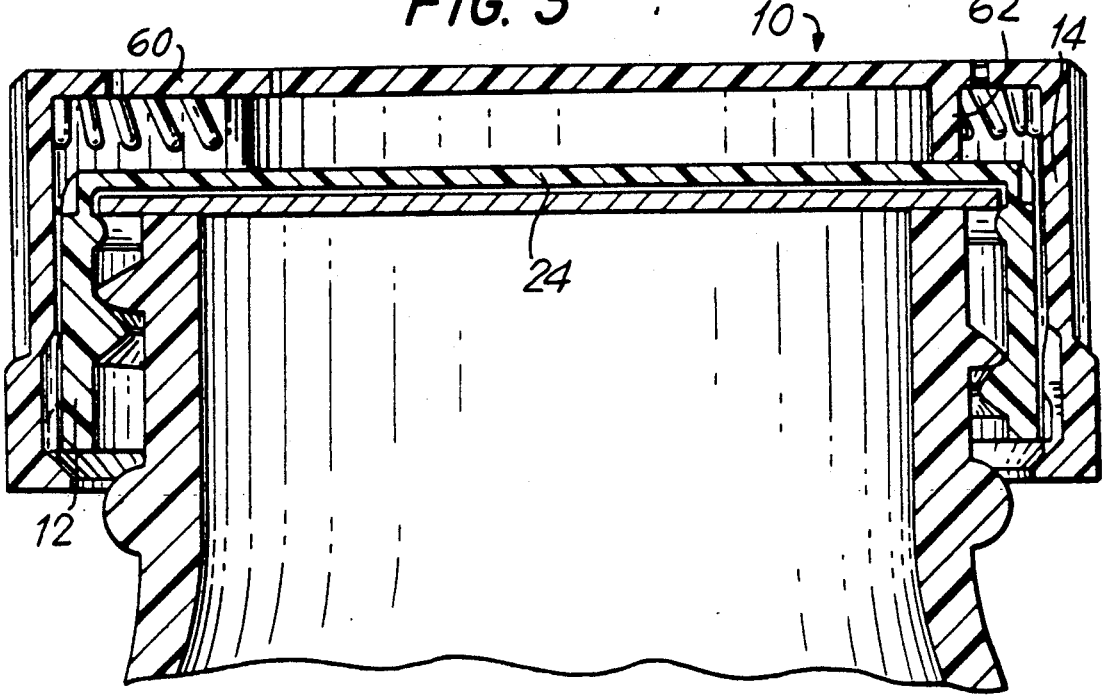
FIG. 3 is a cross-sectional view of the tamper-evident child-proof closure device of FIGS. 1 and 2 taken through section line 3—3 of FIG. 2.
Figure 4:
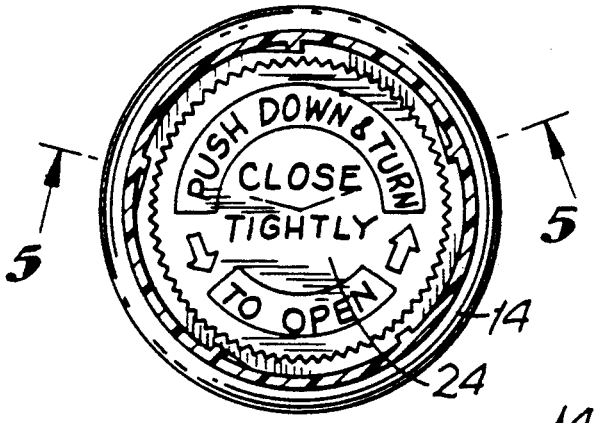
FIG. 4 is a top plan view of the child-proof closure device of FIGS. 1-3 after the tamper-evident tab has been removed.
Figure 5:
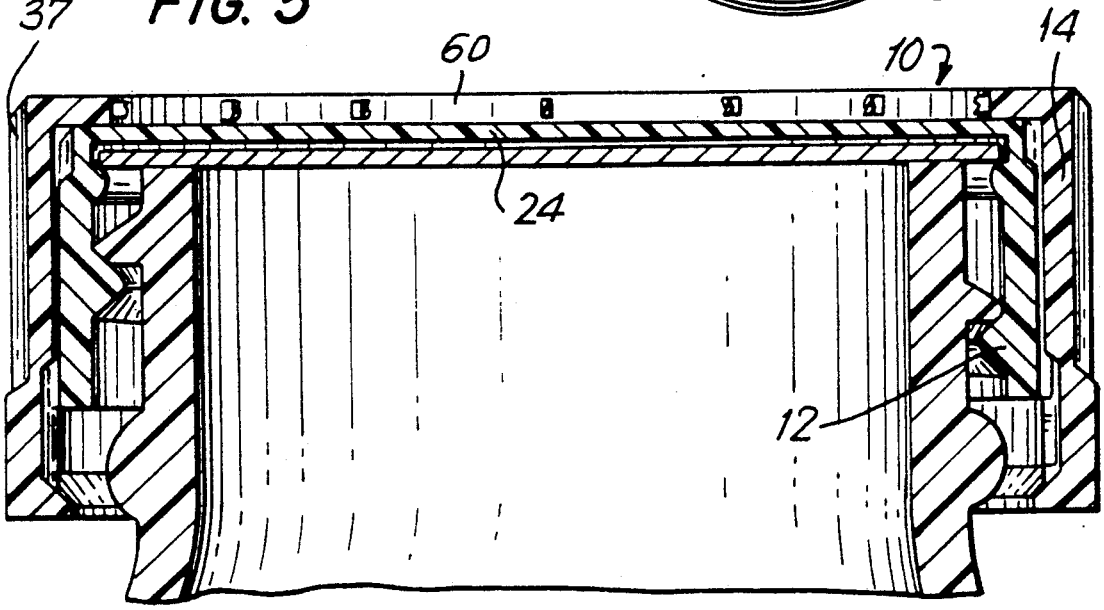
FIG. 5 is a cross-sectional view of the child-proof closure device of FIG. 4 taken through section line 5—5 of FIG. 4.

As shown particularly in FIGS. 2 and 3, pull-tab 60 on removable tamper-evident portion 58 permits portion 58 to be removed from cap cover 60 by breaking connecting tabs 56. Any such pull tab 61 or other disconnecting means for performing this function can be used.

The embodiment of FIGS. 1–5, as shown, is used as follows. Inner cap 12 is positioned inside outer cap 14 and is maintained in position by inwardly extending flange 38 on outer cap 14. With notches 30 on radial flange 20 of inner cap 12 in engagement with projections 44 on lowermost section 42 of outer cap 14, the entire assembly is threadedly engaged with threaded neck 16 of bottle 18. Closure device 10 is now secured on bottle 18. At this time, downwardly extending flange 62 maintains second circle of teeth 50 out of engagement with first circle of teeth 34. Since teeth 34 and 50 cannot be engaged, closure device 10 cannot be taken off bottle 18.

When one desires to open the bottle 18, pull-tab 60 of removable tamper-evident portion 58 is pulled. This action breaks each of connecting tabs 56 and disassociates removable tamper-evident portion 58 from outer cap cover or top 60. It is preferred that removal or inactivation of the tamper-evident feature be obvious and readily noticeable so that once inactivated, a user or consumer will recognize that the closure had a tamper-evident feature at one time. By making the tamper-evident portion large, this function is readily achieved. Inner cap cover or top 24 is now visible through the opening provided when tamper-evident portion 58 is removed. Bottle 18 remains fitted with closure device 10 of a type common in the art of child resistant closure devices which can be opened by displacing outer cap or drive member 14 axially downwardly with respect to the inner cap 12 and by turning the outer cap in the opening (counter-clockwise) direction while pressing down on the outer cap. Directions for causing second circle of teeth 50 to engage first circle of teeth 34 to permit closure device 10 to be taken off bottle 18 can be printed on inner cap cover 24.

Figure 6:
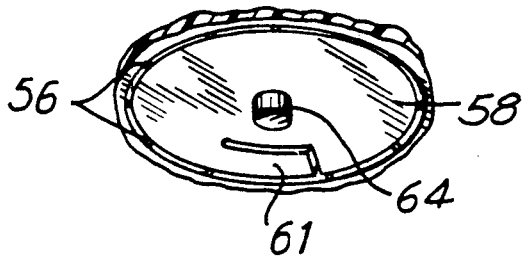
FIG. 6 is a perspective view of a tamper-evident tab on an outer cap constructed and arranged in accordance with an alternate embodiment of the invention.
Figure 7:
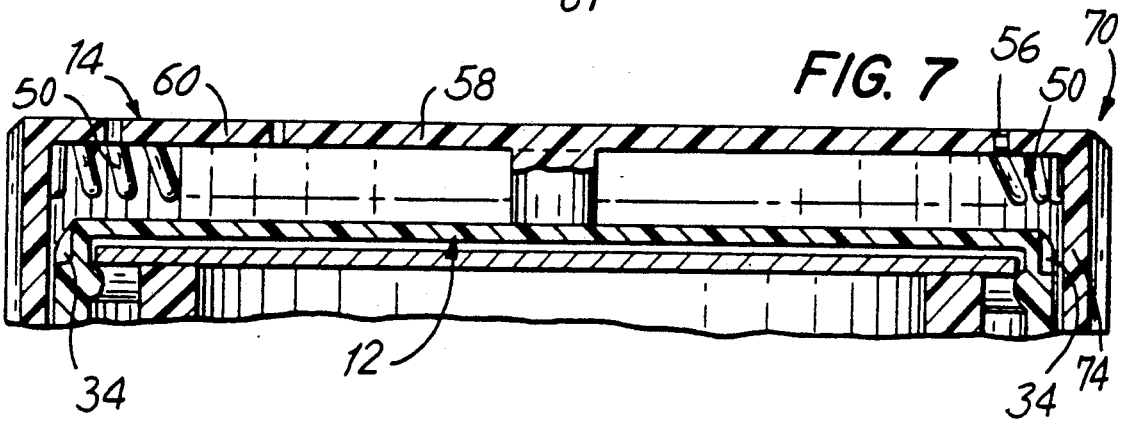
FIG. 7 is a cross-sectional view of a closure device including the tamper-evident tab of FIG. 6 in use on a bottle.

In one alternate exemplary embodiment shown in FIGS. 6 and 7, a downwardly extending stud 64 replaces downwardly extending flange 62 as the tamper-evident feature provided on removable tamper-evident portion 58 of outer cap 14 in a manner similar to that of flange 62. In all other respects, construction of closure device 10 is discussed above. A cross-sectional view showing a closure device 70 having downwardly extending tab 64 on outer cap 74 to maintain second circle of teeth 50 out of engagement with first circle of teeth 34 is shown in FIG. 7. Tamper-evident portion 58 can be removed from upwardly extending flange 54 of outer cap 14 by pulling on pull-tab 61 in order to break connecting tabs 56. Once tamper-evident portion 58 is removed, an ordinary child-proof closure is provided. Of course, more than one stud 64 may be used without departing from this invention.

Figure 8:
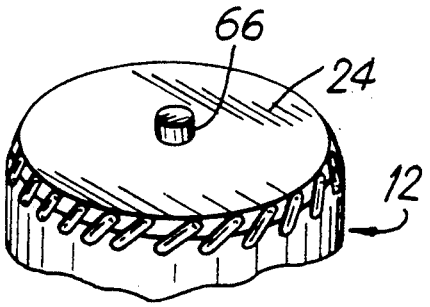
FIG. 8 is an alternate embodiment of a tamper-evident tab on an inner cap constructed and arranged in accordance with a further alternate embodiment of the invention.
Figure 9:
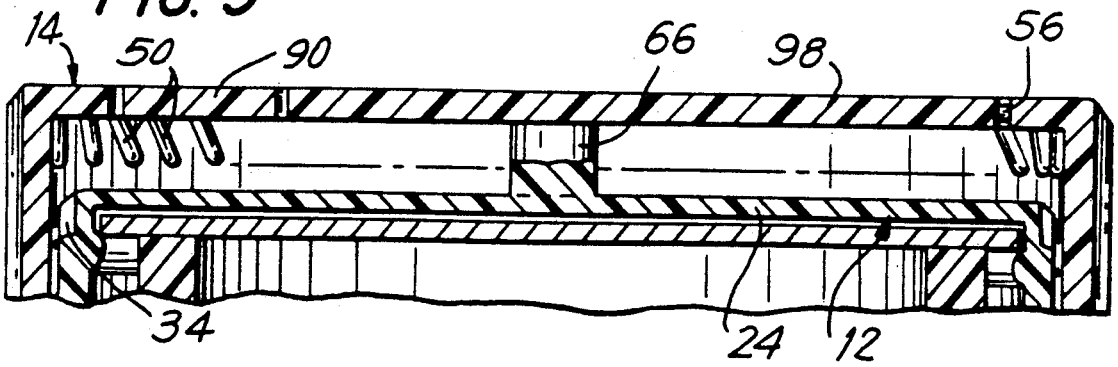
FIG. 9 is a cross-sectional view of a closure device including the tamper-evident tab of FIG. 8 in use on a bottle.

In another alternate exemplary embodiment shown in FIGS. 8 and 9, an upwardly extending stud 66 is provided on cover 24 of inner cap 12. In this embodiment, removable tamper-evident portion 98 is provided on outer cap 14 but is substantially planar and rests on upwardly extending stud 66 to prevent longitudinal movement. Tamper-evident portion 98 can be removed by pulling on pull tab 90. This leaves upwardly extending stud 66 on inner cap 12. However, since tamper-evident portion 98 has been removed, engagement of second circle of teeth 50 with first circle of teeth 34 is no longer prevented by the stud 66 hitting the tamper-evident removable portion 98.

Figure 10:
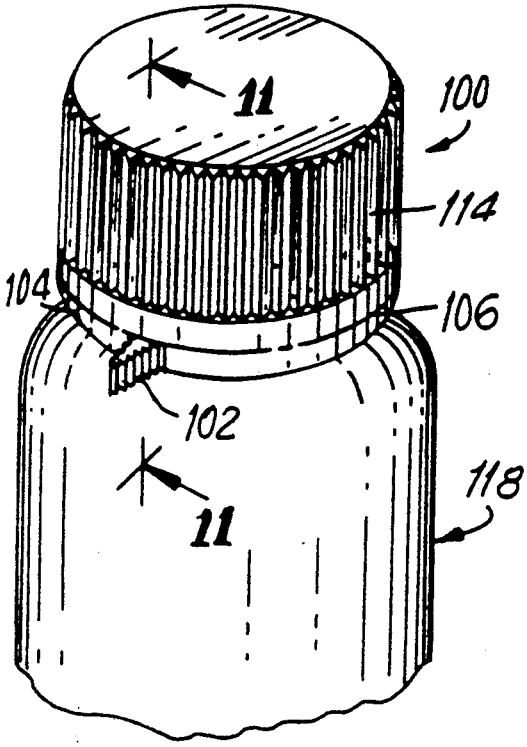
FIG. 10 is a perspective view of a tamper-evident child-proof closure device and bottle constructed and arranged in accordance with still another embodiment of the invention.
Figure 11:
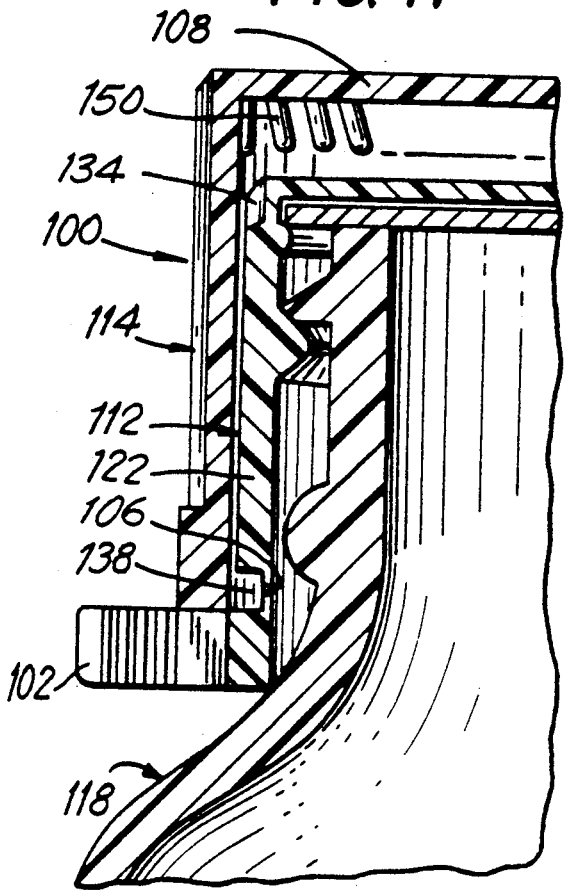
FIG. 11 is a cross-sectional view of the closure device of FIG. 10 taken through section line 11—11 of FIG. 10.
Figure 12:
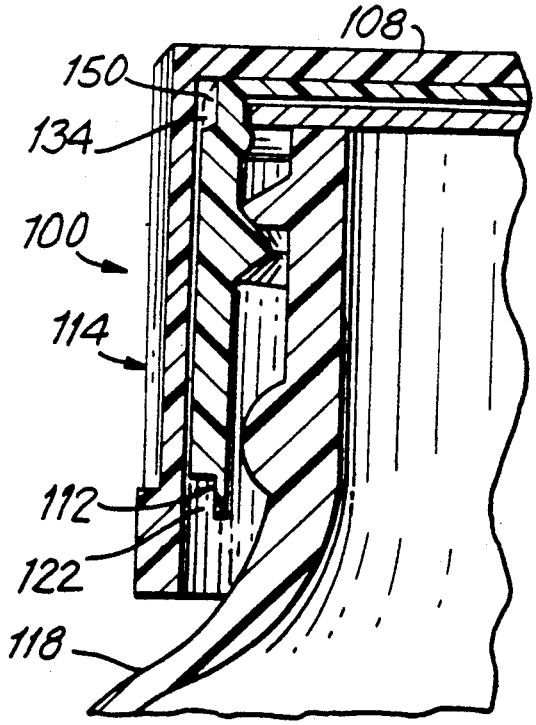
FIG. 12 is a cross-sectional view similar to that of FIG. 11 after a tamper-evident tab has been removed.

Still another alternate exemplary embodiment of the invention is shown in FIGS. 10 to 12 wherein closure device 100 includes inner cap 112 and outer cap or drive member 114. In this embodiment, outer cap 114 is a unitary one-piece construction having no removable portions. However, inner cap skirt 122 includes a removable tab 102 and protection means in the form of a strip 104 along a bottom thereof. Removable strip 104 is provided as a circular strip extending around the entire circumference of inner cap skirt 122. In a manner similar to that shown in the previous embodiments, removable strip 104 maintains second circle of teeth 150 out of engagement with first circle of teeth 134 until after the first time that it is removed. To remove strip 104, one pulls on removable tab 102 which in turn breaks off protection means 104 at a weakened area 106 extending around the entire circumference thereof and defined by the inward deflected retaining flange 138 on outer cup 114. Directions for removing tab 102 and protection means 104 can be provided on top 108 of outer cap 114, for example, by printing, molding, embossing, impressing and the like. Once protection means 102 and 104 has been removed by pulling on removable tab 102, outer cap 114 can be moved longitudinally into position so that second circle of teeth 150 can be brought into engagement with first circle of teeth 134 to remove closure device 100 from bottle 118. Accordingly, an ordinary child resistant closure is provided. Preferably, the weakened area 106 is sufficiently weak so that if one attempts to unscrew inner cap 112 from bottle 118, the effort will sheer the inner cap at area 106 whereby to yield an evident indication of tampering.

It is to be understood that the closure devices provided in accordance with the invention can be formed of any suitable material such as plastics and the like and the invention is not intended to be limited by the material from which the devices are formed. Suitable materials include, but are not limited to, plastics such as polypropylene and the like or metal materials.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A tamper-evident child resistant screw-on closure for use on a container having a threaded portion threadedly engageable with said screw-on closure, comprising:

an inner cap comprising a top and a cylindrical skirt depending from said top. the inner surface of said skirt being threaded for said threaded engagement with said container when said inner cap is rotated in one direction and is disengageable therefrom when said inner cap is rotated in the opposite direction;

an outer cap comprising a top and a cylindrical skirt coaxial with and surrounding the skirt of said inner cap, said inner and outer caps being in close confronting relation and being coaxially movable relative to one another;

the inner surface of said skirt of said outer cap having a first set of knurling extending away from the top thereof in an angular direction extending axially and in said one direction and the outer surface of said skirt of said inner cap having a second set of knurling complementary to said first set of knurling so that when said outer cap is turned in said one direction said first and second sets of knurling will meet to cam said outer cap relative to said inner cap axially toward said inner cap to rotate said inner cap in said one direction to threadedly engage said inner cap on said container and when said outer cap is rotated in said opposite direction said first and second sets of knurling will cam said outer cap axially away from said inner cap to prevent the rotation of said inner cap in said opposite direction to open said container, the camming of said outer cap axially away from said inner cap being preventable by the manual exertion of an axial force on said outer cap toward said inner cap to enable said outer cap to impart rotation to said inner cap in said opposite direction when such axial force is applied;

cooperating engageable means on said inner and outer caps for holding said inner and outer caps in a position axially away from one another whereby to prevent the meshing of said first and second sets of knurling to impart rotation to said inner cap by rotation of said outer cap through said meshed knurling, at least one of said cooperating engageable means being movable out of engagement with the other of said cooperating engageable means to permit the axial movement of said outer cap toward said inner cap, whereby to mesh said first and second sets of knurling, the movement of said one cooperating engageable means out of engagement with the other being readily visually detectable whereby to make tampering with said container visually evident; and one-way drive means for imparting rotation to the inner cap when the outer cap is rotated in the closing direction but not for imparting rotation to the inner cap in the opening direction when said outer cap is turned in said opening direction.

2. The tamper-evident child resistant closure of claim 1, wherein the one-way drive means includes an outwardly direction flange provided on the inner cap skirt, said flange having at least one notch, and at least one projection on an inner surface of an outer cap skirt for engagement with the at least one notch to maintain the integrity of the closure device during initial securement to a container.

* * * * *